US007234865B2

(12) United States Patent
Piechocki

(10) Patent No.: US 7,234,865 B2
(45) Date of Patent: Jun. 26, 2007

(54) CLOSURE FOR A RECLOSABLE PACKAGE

(75) Inventor: Duane Piechocki, Pleasantville, NY (US)

(73) Assignee: Illinois Tool Works Inc., Glenview, IL (US)

( * ) Notice: Subject to any disclaimer, the term of this patent is extended or adjusted under 35 U.S.C. 154(b) by 341 days.

(21) Appl. No.: 10/153,376

(22) Filed: May 22, 2002

(65) Prior Publication Data

US 2003/0219174 A1 Nov. 27, 2003

(51) Int. Cl.
*B65D 33/16* (2006.01)
*A44B 19/00* (2006.01)

(52) U.S. Cl. ..... 383/63; 24/585.12

(58) Field of Classification Search ..... 383/63–65, 383/61.2, 59; 24/585.12, 400, DIG. 50
See application file for complete search history.

(56) References Cited

U.S. PATENT DOCUMENTS 1,703,712 A * 2/1929 Aud ..... 383/64
2,715,759 A * 8/1955 Poux ..... 24/400
3,325,084 A * 6/1967 Ausnit ..... 229/77
3,338,285 A * 8/1967 Jaster et al. ..... 383/65
3,371,848 A * 3/1968 Ward et al. ..... 220/270
3,416,199 A * 12/1968 Imamura ..... 24/585.12
4,020,884 A * 5/1977 Jadot ..... 383/63
4,841,603 A * 6/1989 Ragni ..... 24/584.1
5,189,765 A * 3/1993 Singhal ..... 24/400
5,293,672 A * 3/1994 Tominaga et al. ..... 24/585.1
5,520,463 A * 5/1996 Tilman ..... 383/63
6,009,603 A * 1/2000 Gallagher ..... 24/585.12

FOREIGN PATENT DOCUMENTS

DE 595 874 4/1934

* cited by examiner

*Primary Examiner*—Jes F. Pascua
(74) *Attorney, Agent, or Firm*—Day Pitney LLP

(57) ABSTRACT

A zipper closure for a reclosable bag has a male profile and a female profile, the male profile being snappingly engagable within the female profile to close the zipper closure. One of the male and female profiles includes a collapsible element which forms a hermetic seal between the male and female profiles when the male profile is engaged within the female profile.

4 Claims, 3 Drawing Sheets

CLOSURE FOR A RECLOSABLE PACKAGE

BACKGROUND OF THE INVENTION

1. Field of the Invention

The present invention relates to the packaging art, and, more particularly, to the art of reclosable plastic bags or packages having extruded zippers. In particular, the present invention relates to extruded zippers having two mutually interlocking members, at least one of which is partially collapsible so as to form a tight seal when interlocked with the other.

2. Description of the Prior Art

Reclosable bags used, for example, for storing household foodstuffs are typically made of polyethylene. As shown in U.S. Pat. No. 3,416,199 to Imamura, which is commonly assigned with the present invention, a reclosable bag may be formed of two opposed walls and having a mouth equipped with fastener profiles. These profiles include a male profile attached to one wall and a female profile attached to the other wall. The profiles are shaped so that, when they are aligned and pressed together into an engaging relationship, they form a continuous closure for the bag. The bag may be opened by pulling the walls apart at the mouth, thereby separating the male and female profiles from one another.

The prior art is replete with different shapes and arrangements for the male and female profiles. In many cases, the profiles are designed to provide relatively high resistance to opening from inside the package, while rendering the package relatively easy to open from the outside.

Because the male and female profiles must be shaped so as to be readily interlocked with one another, they may not form an entirely airtight closure. For this reason, peel seals are used in the reclosable plastic packages used for the retail sale of foodstuffs to ensure that the packages remain hermetically sealed prior to sale. Moreover, the peel seals can also serve a tamper-evident function by whitening or otherwise discoloring when being opened, thereby providing a means by which a prospective purchaser could be alerted to the possibility that the package had been opened prior to purchase.

Following purchase, there may still be a need to form a hermetic seal after the initial opening of the package to preserve the freshness of any contents remaining in the package. The present invention is an extruded zipper having male and female profiles which provide such a seal.

SUMMARY OF THE INVENTION

Accordingly, the present invention is a zipper closure, and a reclosable bag which incorporates the zipper closure.

The zipper closure comprises a male profile and a female profile, the male profile being snappingly engagable within the female profile. In accordance with the present invention, one of the male and female profiles includes a collapsible element which forms a hermetic seal when the male profile is engaged within the female profile.

The present invention will now be described in more complete detail, with frequent reference being made to the drawings identified below.

DETAILED DESCRIPTION OF THE PREFERRED EMBODIMENT

Figure 1:
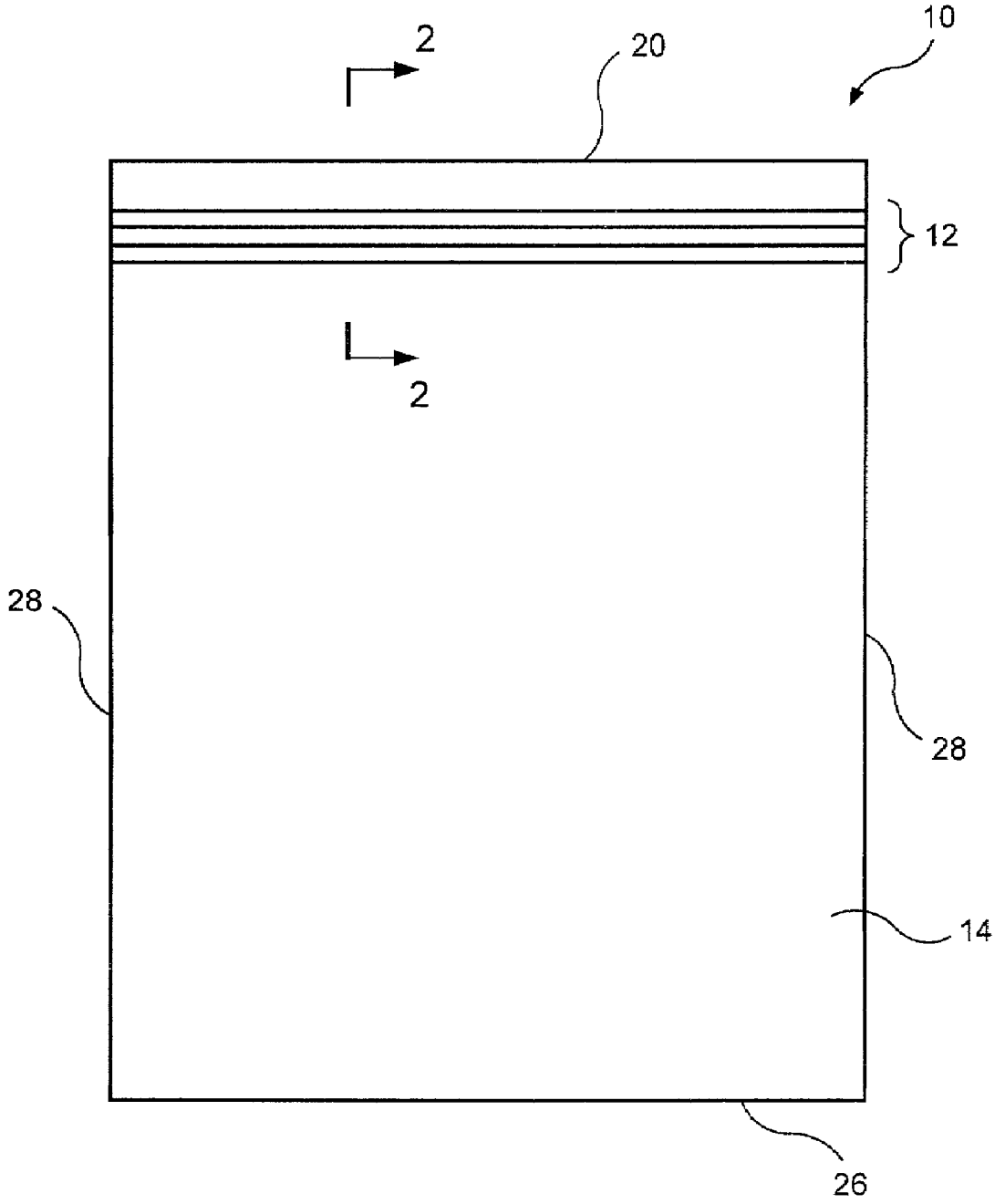
FIG. 1 is a plan view of a reclosable bag having the zipper closure of the present invention.
Figure 2:
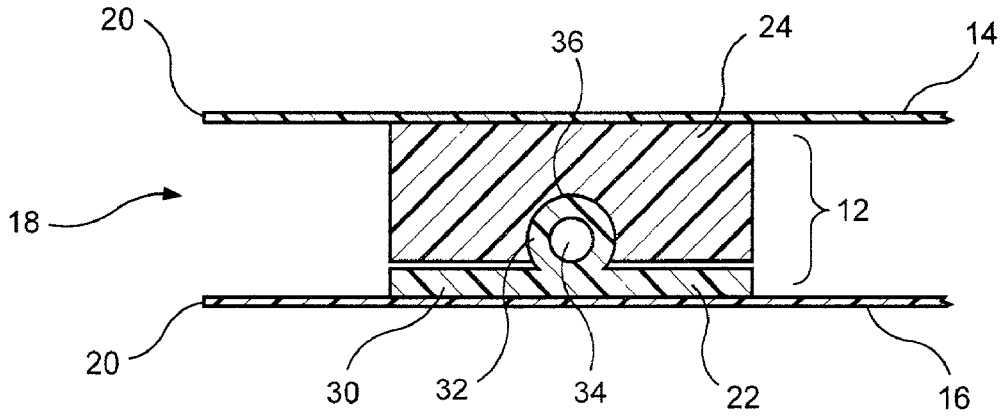
FIG. 2 is a cross-sectional view taken as indicated in FIG. 1.

Referring now to the drawings, and specifically to FIGS. 1 and 2, a reclosable bag 10 having the extruded zipper 12 of the present invention includes front and rear walls 14,16 seamed along three edges thereby forming an enclosure with an opening or mouth 18 along the top or fourth edge 20.

The bag 10 is preferably made of thermoplastic material, such as polyethylene, by extrusion. Attached to the internal faces of walls 14,16 near mouth 18 are male and female profiles 22,24, respectively, of zipper 12, which extends continuously across the width of the bag 10. The zipper 12, comprising male and female profiles 22,24, serves to close the mouth 18 of the bag 10 when the male and female profiles 22,24 are interlocked with one another. The male and female profiles 22,24 are extruded from a polymeric resin material, such as polyethylene, and attached to the front and rear walls 16,18 at some stage in the process by which bags 10 are manufactured.

Although male and female profiles 22,24 are shown in FIG. 2 to be separate from and attached to front and rear walls 14,16, respectively, it should be understood that they may be integrally formed therewith by coextrusion. Specifically, male profile 22 may be coextruded with rear wall 16, while female profile 24 may be coextruded with front wall 14. Moreover, the front and rear walls 14,16 may be part of a single sheet which is folded along the bottom 26 and sealed along the sides 28. Each of these variations may be used without departing from the scope of the present invention as defined in the appended claims.

Referring, now, more specifically to FIG. 2, the male profile 22 includes a base or web 30 and a projecting element or bulb 32 of substantially cylindrical cross-section. The bulb 32 has a hollow core 34, which allows the bulb 32 to collapse somewhat when compressed, and to return essentially to its original shape when compression is removed.

The female profile 24 has a groove 36 which is also of substantially cylindrical cross section. In accordance with the present invention, the cross section of the bulb 32 of the male profile 22 is the same size as or slightly larger than the cross section of the groove 36 of the female profile 24. As a consequence, when the bulb 32 is pushed into groove 36, the bulb 32 collapses because of its hollow core 34. Once inside the groove 36, however, the bulb 32 tends to return to its original shape, making intimate contact with the walls of the groove 36, and thereby making a hermetic seal for the bag 10.

Figure 3:
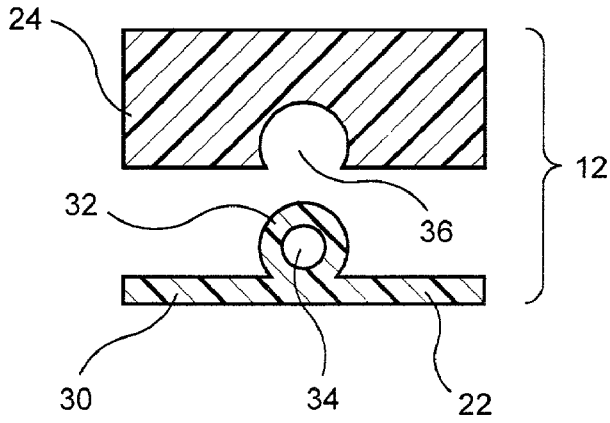
FIG. 3 is a cross-sectional view of the zipper closure of the present invention.

FIG. 3 is a cross-sectional view of zipper 20, shown, for the sake of clarity, unattached to front and rear walls 14,16 and with male and female profiles 22,24 separated from one another.

Figure 4:
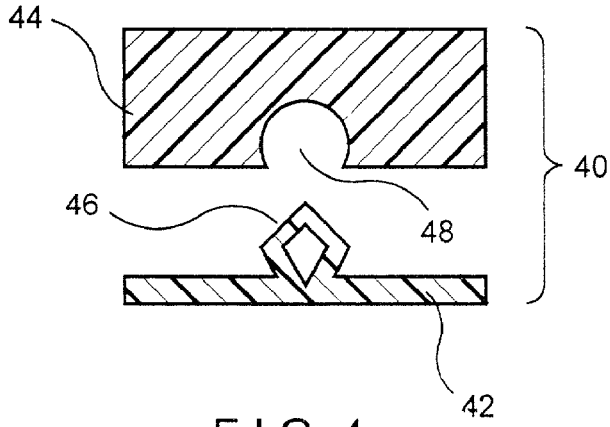
FIG. 4 is a cross-sectional view of an alternate embodiment of the zipper closure.

FIG. 4 is a cross-sectional view, analogous to that presented in FIG. 3, of an alternate embodiment of the zipper. As such, zipper 40 comprises male and female profiles 42,44. Male profile 42 differs from that shown in FIG. 3 by virtue of the fact that bulb 46 has a diamond-shaped cross section which may be easier to insert into groove 48 of female profile 44 than bulb 32.

Figure 5A:
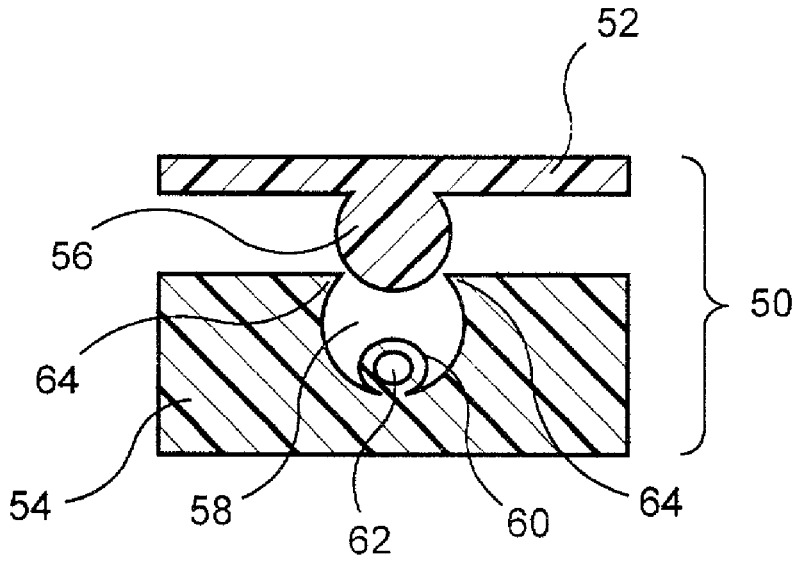
FIGS. 5A and 5B are cross-sectional views of another embodiment of the zipper closure.
Figure 5B:
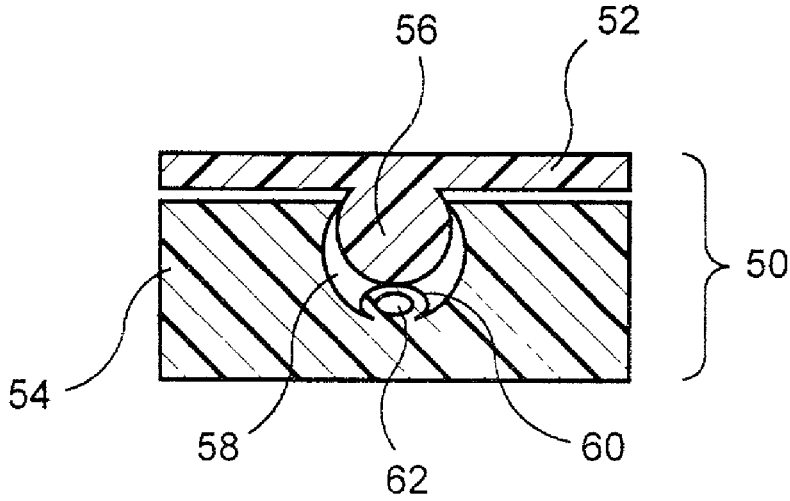

FIGS. 5A and 5B show still another alternate embodiment of the zipper. As such, zipper 50 comprises male and female profiles 52,54, shown separated from one another in FIG. 5A, but joined together in FIG. 5B.

As above, male profile 52 includes a projecting element or bulb 56, although, in this embodiment, it lacks a hollow core. Female profile 54 again has a groove 58, although it is somewhat larger in cross section than the bulb 56, but has edges 64 which snap around the bulb 56.

Within the groove 58, however, is a projecting element or bulb 60 having a hollow core 62. When the male profile 52 is joined to the female profile 54 by inserting the bulb 56 into the groove 58 and snappingly engaging it therein, bulb 56 compresses bulb 60 which, because of its hollow core 62, flattens to make intimate contact therewith, and thereby to make a hermetic seal for the bag 10.

Obviously, numerous modifications may be made to this invention without departing from its scope as defined in the appended claims.

What is claimed is:

1. A zipper closure comprising a male profile and a female profile, said female profile being partially cylindrical through greater than 180 degrees, said male profile being snappingly engagable within said female profile, wherein one of said male and female profiles includes a collapsible element forming a hermetic seal when said male profile is engaged within said female profile, wherein said male profile comprises an at least partially cylindrical projecting element having a hollow core, and said female profile comprises a groove wherein said at least partially cylindrical element is snappingly engagable, said hollow core making said bulb-shaped projecting element collapsible.

2. A zipper closure comprising a male profile and a female profile, said female profile being partially cylindrical through greater than 180 degrees, said male profile being snappingly engagable within said female profile, wherein one of said male and female profiles includes a collapsible element forming a hermetic seal when said male profile is engaged within said female profile, wherein said male profile comprises a diamond-shaped projecting element having a hollow core, and said female profile comprises a groove wherein said diamond-shaped projecting element is snappingly engagable, said hollow core making said diamond-shaped projecting element collapsible.

3. A reclosable bag comprising:

a first wall and a second wall joined to form an enclosure with a mouth defined by wall edges, a zipper closure for selectively opening and closing said bag, said zipper closure comprising a male profile and a female profile, said male profile extending along an internal surface of said first wall adjacent to said mouth and said female profile being partially cylindrical through greater than 180 degrees and extending along an internal surface of said second wall adjacent to said mouth, said male and female profiles being snappingly engagable with one another to close said bag, wherein one of said male and female profiles includes a collapsible element forming a hermetic seal when said male and female profiles are engaged with one another; and wherein said male profile comprises an at least partially cylindrical projecting element having a hollow core, and said female profile comprises a groove wherein said at least partially cylindrical projecting element is snappingly engagable, said hollow core making said at least partially cylindrical projecting element collapsible.

4. A reclosable bag comprising:

a first wall and a second wall joined to form an enclosure with a mouth defined by wall edges, a zipper closure for selectively opening and closing said bag, said zipper closure comprising a male profile and a female profile, said male profile extending along an internal surface of said first wall adjacent to said mouth and said female profile being partially cylindrical through greater than 180 degrees and extending along an internal surface of said second wall adjacent to said mouth, said male and female profiles being snappingly engagable with one another to close said bag, wherein one of said male and female profiles includes a collapsible element forming a hermetic seal when said male and female profiles are engaged with one another; and wherein said male profile comprises a diamond-shaped projecting element having a hollow core, and said female profile comprises a groove wherein said diamond-shaped projecting element is snappingly engagable, said hollow core making said diamond-shaped projecting element collapsible.

* * * * *